US006814636B2

(12) United States Patent
Nolen

(10) Patent No.: US 6,814,636 B2
(45) Date of Patent: Nov. 9, 2004

(54) MARINE RADIAL SURFACE DRIVE

(75) Inventor: Gregory Lynn Nolen, Aptos, CA (US)

(73) Assignee: Greg L. Nolen, Aptos, CA (US)

( * ) Notice: Subject to any disclaimer, the term of this patent is extended or adjusted under 35 U.S.C. 154(b) by 0 days.

(21) Appl. No.: 10/692,505

(22) Filed: Oct. 23, 2003

(65) Prior Publication Data

US 2004/0127115 A1 Jul. 1, 2004

Related U.S. Application Data

(60) Provisional application No. 60/422,910, filed on Nov. 1, 2002.

(51) Int. Cl.[7] ..... B63H 1/04
(52) U.S. Cl. ..... 440/90; 440/91
(58) Field of Search ..... 440/51, 90, 91, 440/92, 61 R, 61 T

(56) References Cited

U.S. PATENT DOCUMENTS 4,832,642 A * 5/1989 Thompson ..... 440/90
5,667,415 A * 9/1997 Arneson ..... 440/66
5,785,564 A * 7/1998 Von Ohain et al. ..... 440/90
6,264,518 B1 * 7/2001 Price ..... 440/91

* cited by examiner

*Primary Examiner*—Stephen Avila

(57) ABSTRACT

A marine outdrive attachable to the transom of a boat having a conventional inboard engine and transmission. Said drive includes an aft support member extending rearwardly and pivotably attached to the transom whereby hydraulic actuators control vertical elevation of said member. Said member supports an axle upon which is journalled a cylinder with a plurity of contiguous and articulated blades, suitably attached so as to produce thrust when cylinder is rotated about the axle in a radial manner and said blades are brought into contact with water. Said cylinder is operably connected to the transmission in a conventional manner, which is operably connected to the engine in a conventional manner. Said blades are operably connected to an eccentric load cam within said cylinder that controls said blade angle throughout rotation, whereby delivered thrust can be continuously adjusted while underway. Said blades having unique shape and attributes whereby said blade's ability to produce thrust is optimized. A rudder assembly is suitably attached to the rearward end of said member and operably connected to the helm of the boat in a conventional manner.

20 Claims, 11 Drawing Sheets

MARINE RADIAL SURFACE DRIVE

This application is entitled to the earlier submittal date of the provisional patent application No. 60/422,910 submitted Nov. 1, 2002.

BACKGROUND

This invention relates to marine drives, that by design operate partially above the water surface. Surface drives exhibit far less drag than their fully submerged counter parts and often used for high speed, marine powerboat competition.

Generally, marine surface drives, or "surface piercing propeller drives", can be divided into two categories; fixed and articulated. Fixed surface drives are stationary elements extending aft of the stern and require a separate rudder mechanism to direct thrust horizontally for directional control as illustrated in U.S. Pat. Nos. 4,854,903 and 4,689,026. The articulated versions as illustrated in U.S. Pat. Nos. 6,431,927, 4,790,782, and 4,544,362, has means that allow a drive assembly to move horizontally and/or vertically directing the angle of thrust as needed and generally do not require a separate rudder mechanism.

Disadvantages intrinsic to the "surface piercing propeller drive" are listed below:

(a) Poor reverse or backing performance, attributable to a "cleaver" style propeller design (optimized for surface running).

(b) Propeller-induced side forces, occurring when the top half of the propeller is exposed and a rotational drag of the submerged portion exerts a thrust perpendicular to the direction of forward travel. Large skegs (submerged, stationary fins) as illustrated in U.S. Pat. No. 5,667,415 and counter rotating propellers as illustrated in U.S. Pat. Nos. 4,790,782, and 4,544,362, can compensate for these side forces; however, both remedies result in a net increase of drag.

(c) Difficult optimization of engine performance and boat displacement to propeller size. For many this is trial and error. Most boat owners or operators do not have a broad selection of propellers on hand to evaluate. Nor would most have the equipment and time to evaluate many propellers.

(d) Axial instability occurs when a high speed planing boat equipped with a single, "surface piercing propeller drive", is running at high speed in choppy conditions. The propeller induces an erratic thrust in both the forward direction and to a lesser degree, in the lateral direction as the drive encounters various peaks in the chop. The erratic thrust produced in the lateral direction induces a yaw or pitch to the boat. This affects performance and safety.

Various paddlewheel configurations may also be defined as surface drives, however, due to the invention of the "screw type" propeller, few continue to have commercial application. A major disadvantage of the paddlewheel is the necessity to support the drive and most the paddlewheel above the surface. Efficiency is reduced dramatically when the paddlewheel operates with more than 20% of its diameter submerged. This occurs because a fixed paddle or blade produces thrust continuously as it rotates through the water, however, only thrust produced during the deepest part of the rotation efficiently moves the boat forward. A significant portion of available power is consumed accelerating water down ahead of the paddle wheel and lifting water up aft of the paddle wheel.

Attempts to produce more efficient and consistent thrust with a paddlewheel through the use of articulated blades have been tried as illustrated in U.S. Pat. Nos. 5,297,933, and 2,258,699. These patents and others like them, solve part of the problem by optimizing the contact angle of each paddle or blade relative to a desired direction of force, however the blade or paddle velocity parallel to this line of force is non-linear. Blade velocity (in the direction of the desired line of force) at a point where the blade crosses the horizontal centerline of the paddlewheel rotation is zero. In contrast, the blade velocity (in the direction of the desired line of force) at a point where the blade crosses the vertical centerline (at the bottom of the rotation) is at maximum and equals the rotating velocity of the paddlewheel. As a result the blades seem work against themselves. This problem becomes more pronounced when the paddlewheel is deeply submerged. For purposes of calculating available thrust of a given paddlewheel, an engineer must average the blade velocity as a function of its operating depths and the rotating velocity.

Many of the articulated designs of the prior art achieved the articulation through the use of complex planetary gear arrangements. These would be costly to build relative to a screw type propeller of similar thrust and would be difficult to maintain in a marine environment. In addition, it could be speculated that the friction loss through complex gear arrangements would offset any gains the inventor may have claimed. The large rotating masses associated with the planetary gear arrangements would prevent these designs from being used in a modern competitive powerboat environment.

Other commercial disadvantages of the paddlewheel include; large drive systems relative to screw type propellers, poor handling due to a flat blade design, and an obsolete stigma. The disadvantages of the paddlewheel have limited it to resort-style pedal boats and historic vessels, operating in relatively calm inland waters.

The obsolete paddlewheel, however, has inherent advantages over the "surface piercing propeller drive" such as the absence of propeller-induced side force and low relative drag possibilities.

Objects and Advantages

The marine radial surface drive of the present invention exploits the advantages inherent in the paddle wheel and has several objects and advantages which are:

(a) to provide a radial surface drive that is simple to manufacture and operate and has wide commercial utility;

(b) to provide a radial surface drive with controlled and consistent thrust from a "paddle wheel" configuration;

(c) to provide a radial surface drive of a "paddle wheel" configuration which is relatively small compared with traditional paddlewheels and can be transom mounted in a conventional manner;

(d) to provide a radial surface drive with good reverse capabilities;

(e) to provide a radial surface drive which does not have a lateral or side force like a "surface piercing propeller drive";

(f) to provide a radial surface drive without appendage drag;

(g) to provide a radial surface drive with the ability to trim the boat (alter the vertical angle of delivered thrust) while underway;

(h) to provide a radial surface drive with the ability to limit the magnitude of delivered thrust while underway;

(i) to provide a radial surface drive that by design is open, and easy to inspect and service;

(j) to provide a radial surface drive that is stable under extreme acceleration because the rotation of the drive is radial and not axial;

The marine radial surface drive of the present invention combines known paddlewheel and surface drive concepts with several unique features. The result is a design that is versatile and easy to manufactured with current knowledge and machinery.

As will be seen in the drawings, one example of this, is the unique blade shape and profile which is a major contributor to the overall performance of the surface drive of the present invention. The curved shape of the blades cause them to function under load like turbine vanes, delivering thrust throughout the submerged portion of a rotation much more efficiently than flat blade designs. Two discrete curves are visible in each blade's profile, these allow for efficient operation at multiple depths and provide stability in choppy waters. A slight concave curve is featured along each blade's axial plane, which provides lateral stability under acceleration.

Another unique feature is the placement of an eccentric cam within the blade support cylinder. This "load cam" allows the tip velocity of the blades to be controlled and regulated during the submerged portion of the rotation. The shape of the cam allows the thrust delivered by the drive to be tailored to suite boat displacement and engine efficiency. By changing the position of the cam, the blade's tip velocity and angle can be changed while the boat is underway. Cams with different profiles can be exchanged to suite specific applications or power improvements of a given boat.

Further objects and advantages will become apparent from a consideration of the ensuing description and drawings such as the articulated drive support and shroud. These features are essential to the preferred embodiment, which is a design optimized to replace stern drives within existing boat designs and configurations.

The versatility of the present invention allows for a variety of configurations including; twin drives with a single inboard engine, and twin drives with two inboard engines. As will be seen in the ensuing drawings, boat designs can be engineered around the radial surface drive in a highly stylized manner.

SUMMARY OF THE INVENTION

It is the purpose of this invention to provide a surface drive, which affords the competitive and commercial advantages of the "surface piercing propeller drive", while eliminating the inefficiencies and instabilities associated with propeller induced side forces. Furthermore, it is the purpose of this invention to provide a radial surface drive that by design, allows an operator of a boat so equipped with said drive, to actively control and adjust the relative magnitude, angle and elevation of the thrust delivered by said drive.

The radial surface drive of the present invention is lightweight, easy to fabricate, and requires low maintenance. The present invention may be made from corrosion-resistant materials such as brass, stainless steel, aluminum, and composites to extend the useful life of the apparatus.

The radial surface drive of the present invention has useful application within marine powerboat competition, as well as many useful leisure and/or commercial applications.

A marine radial surface drive of the present invention does not use a screw type propeller operating upon an axial rotation. Instead, such apparatus comprises a plurality of articulated blades of unique shape, affixed to a central hub operating upon a radial rotation. In the present invention, the radial surface drive is affixed to a drive axle that is perpendicular to the centerline or keel of the boat and is secured within an adjustable support member extending aft of a transom and above the surface. A cam within the drive's hub manipulates the angle of the blades during a selectable portion of a rotation and is controlled by the operator. In the preferred embodiment, the aft support member pivots vertically at the transom; hydraulic actuators affixed to the transom and the support member allow operator control of the vertical elevation of drive. In the preferred embodiment, a rudder assembly is attached to the trailing end of the support member. A shroud encloses the forward portion of the drive for safety as well as decreasing blade cavitation at high speeds through aeration. These features are not combined in any known prior art.

DRAWINGS

Drawing Figures

In the drawings, closely related figures have the same number but different alphabetic suffixes.

Figure 7A:
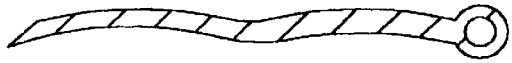
Figure 7B:
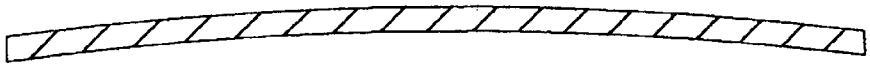

FIGS. 7*a* and 7*b* shows blade sections along the radial and axial plane respectively.

Figure 8A:
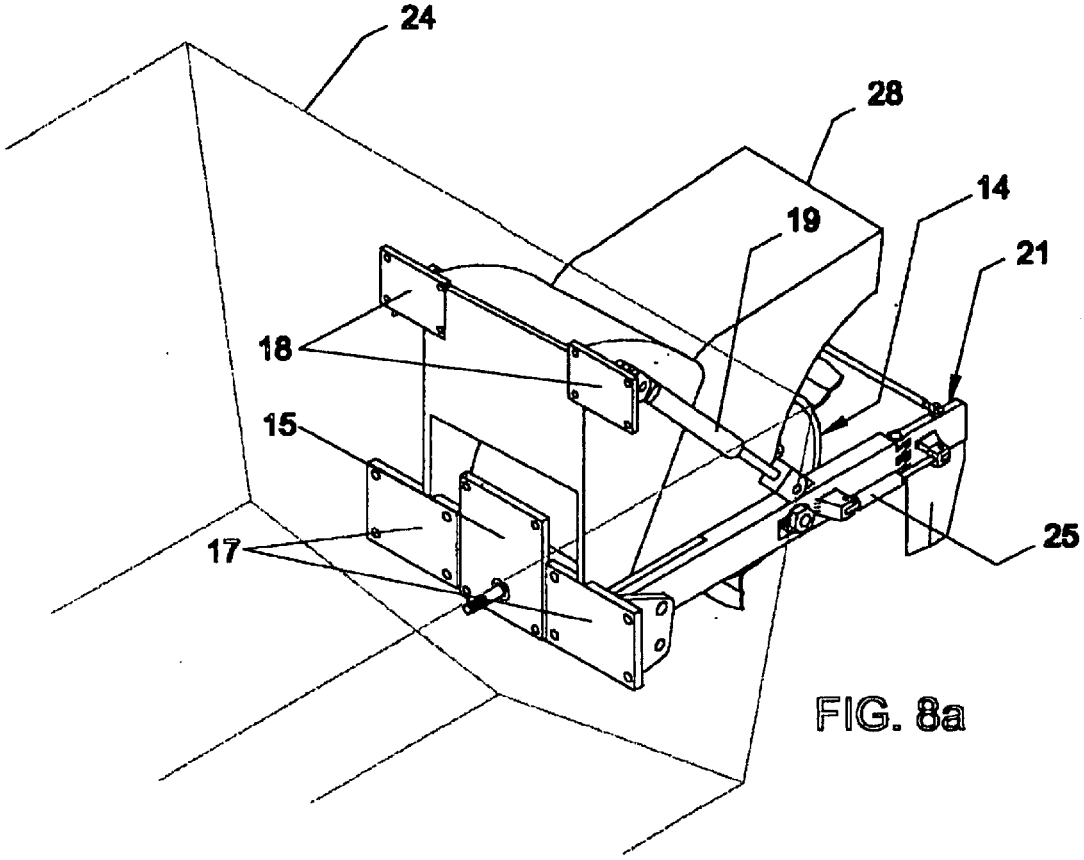
Figure 8B:
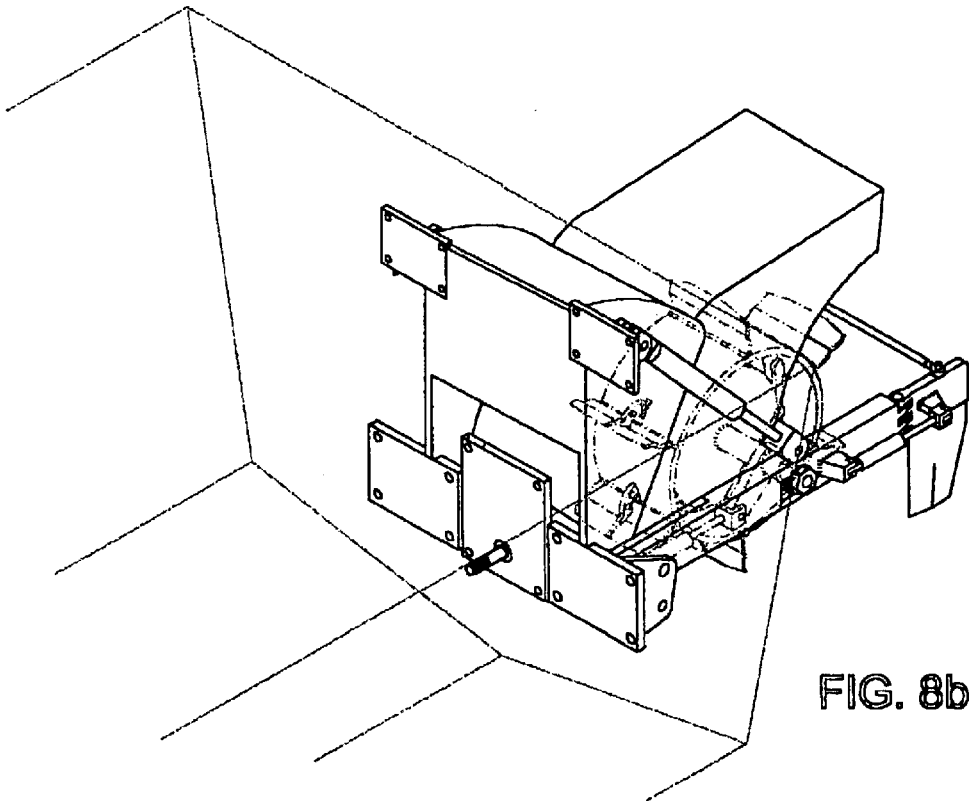

FIGS. 8*a* and 8*b* shows an isometric view of the preferred embodiment with a transparent illustration of the boat and drive components.

Figure 9A:
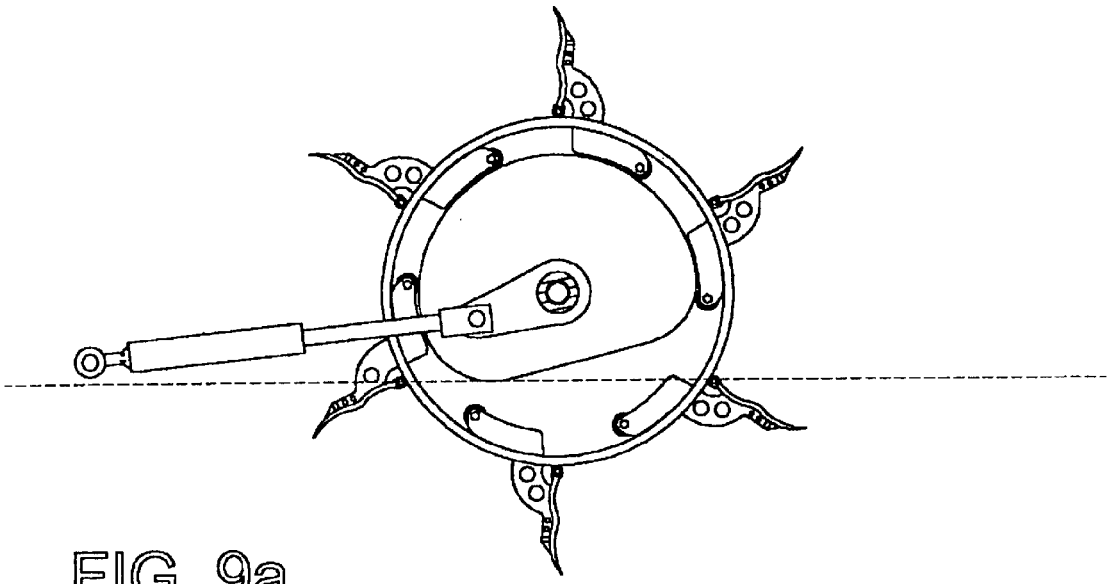

FIG. 9*a* shows an "at rest" or "idle" detail of the blades, support cylinder, load cam and cam actuator, as viewed from the left side with a dashed line representing the theoretical waterline.

Figure 9B:
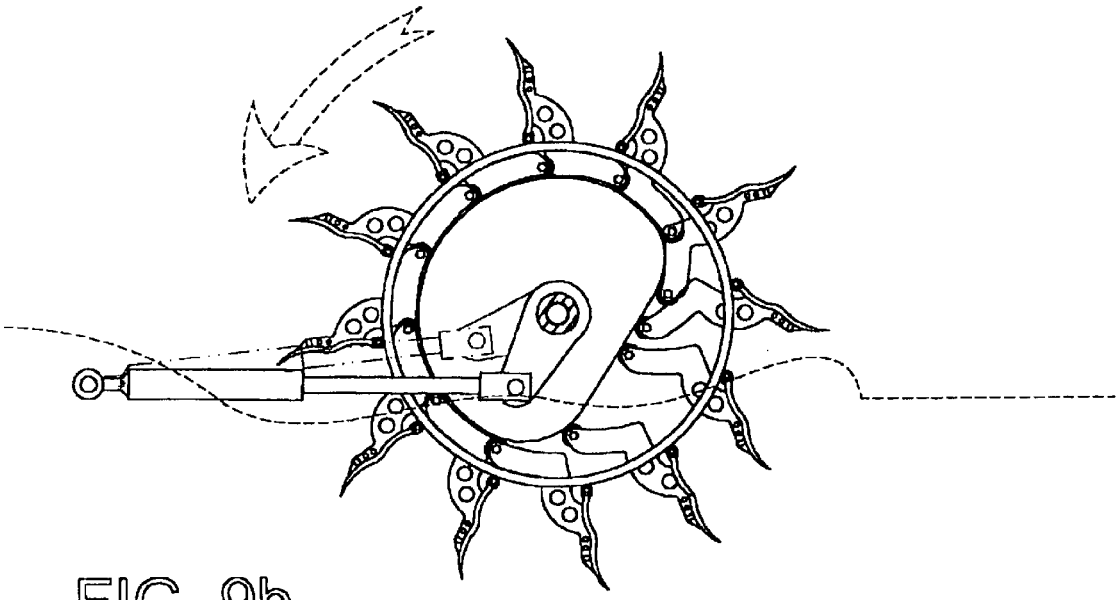

FIG. 9*b* shows the same components illustrated in FIG. 9*a* with 12 blade positions shown at 30-degree points of a given revolution at low to moderate boat speeds with a dashed line representing the theoretical waterline.

Figure 9C:
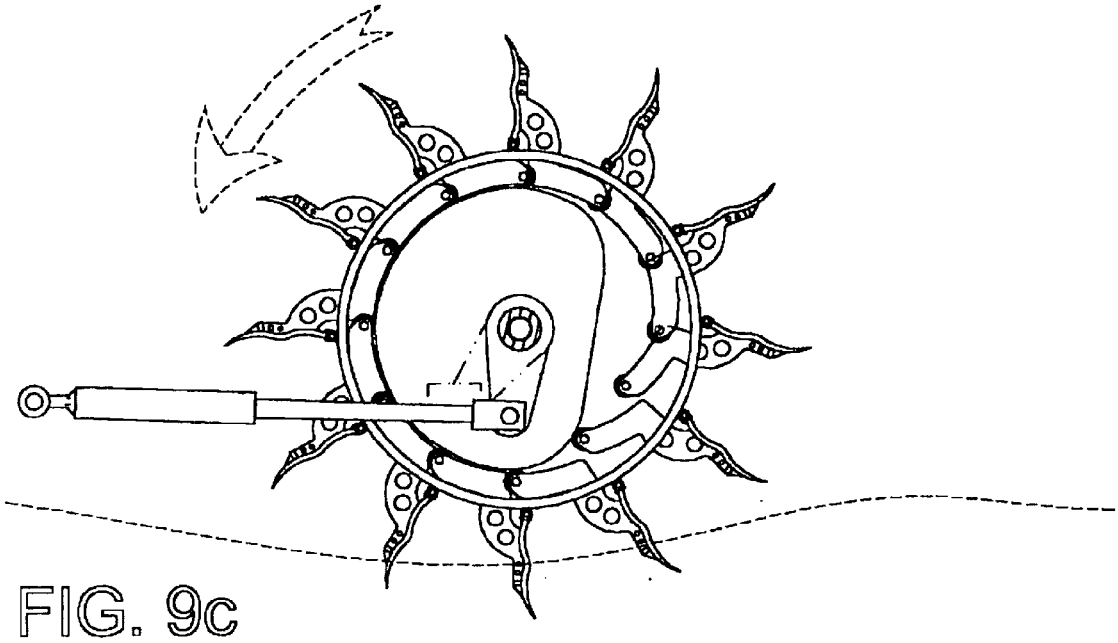

FIG. 9*c* shows the same components illustrated in FIG. 9*a* with 12 blade positions shown at 30-degree points of a given revolution at moderate to maximum boat speeds with a dashed line representing the theoretical waterline.

Figure 9D:
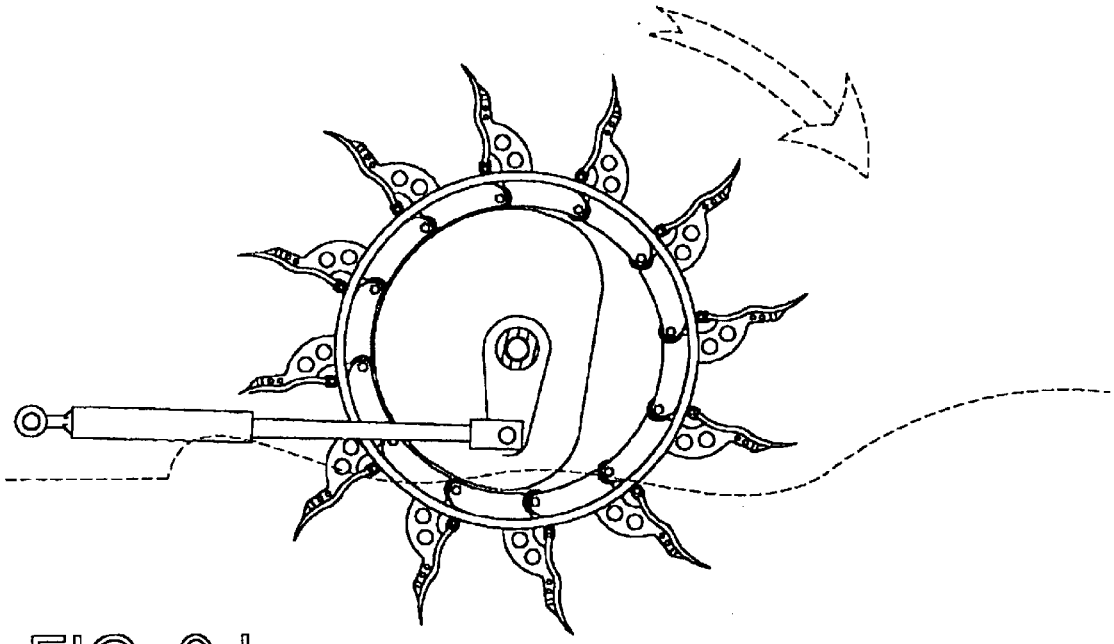

FIG. 9*d* shows the same components illustrated in FIG. 9*a* with 12 blade positions shown at 30-degree points of a given revolution in reverse with a dashed line representing the theoretical waterline.

Figure 10:
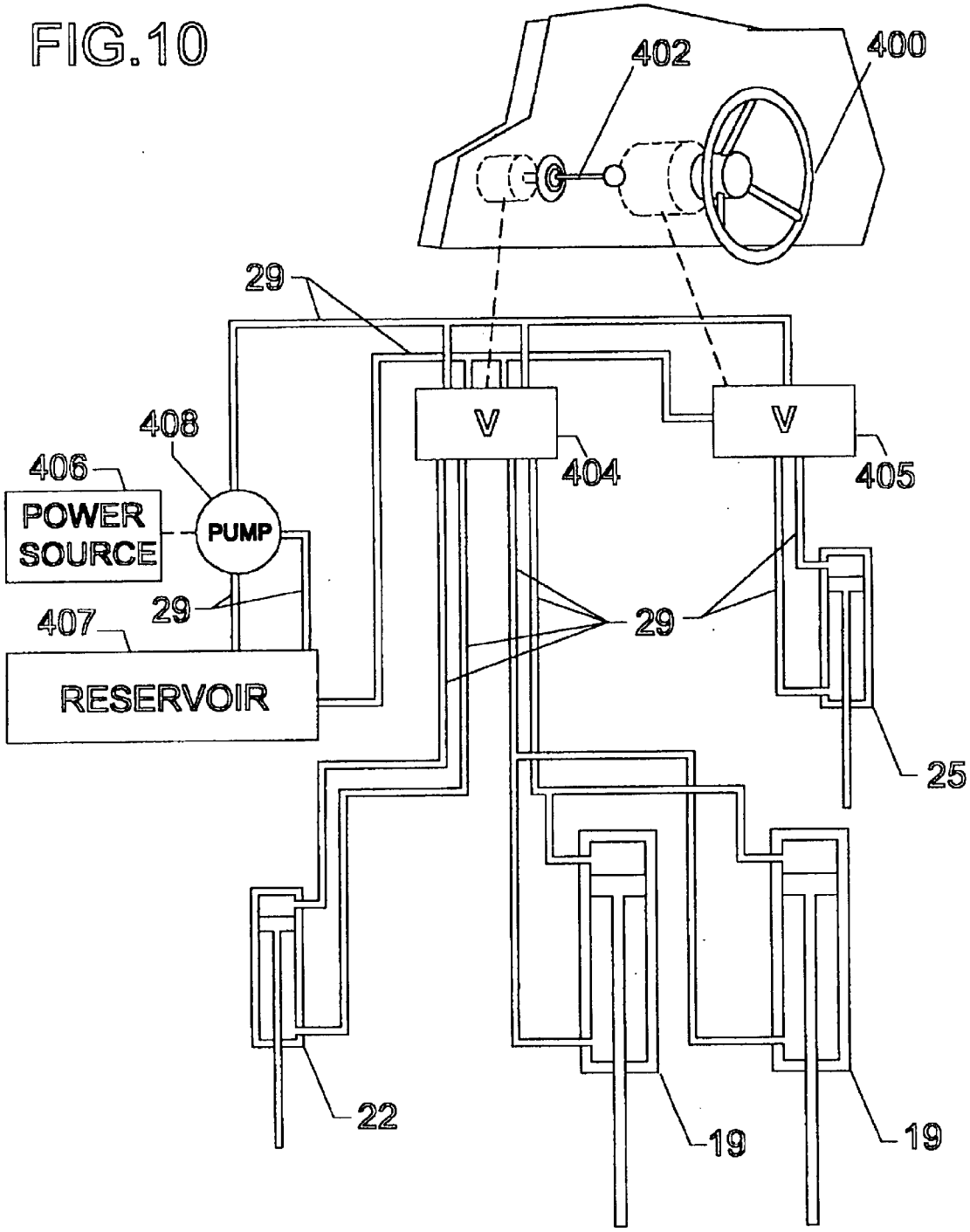

FIG. 10 shows a schematic illustration of the hydraulic control system.

Figure 11A:
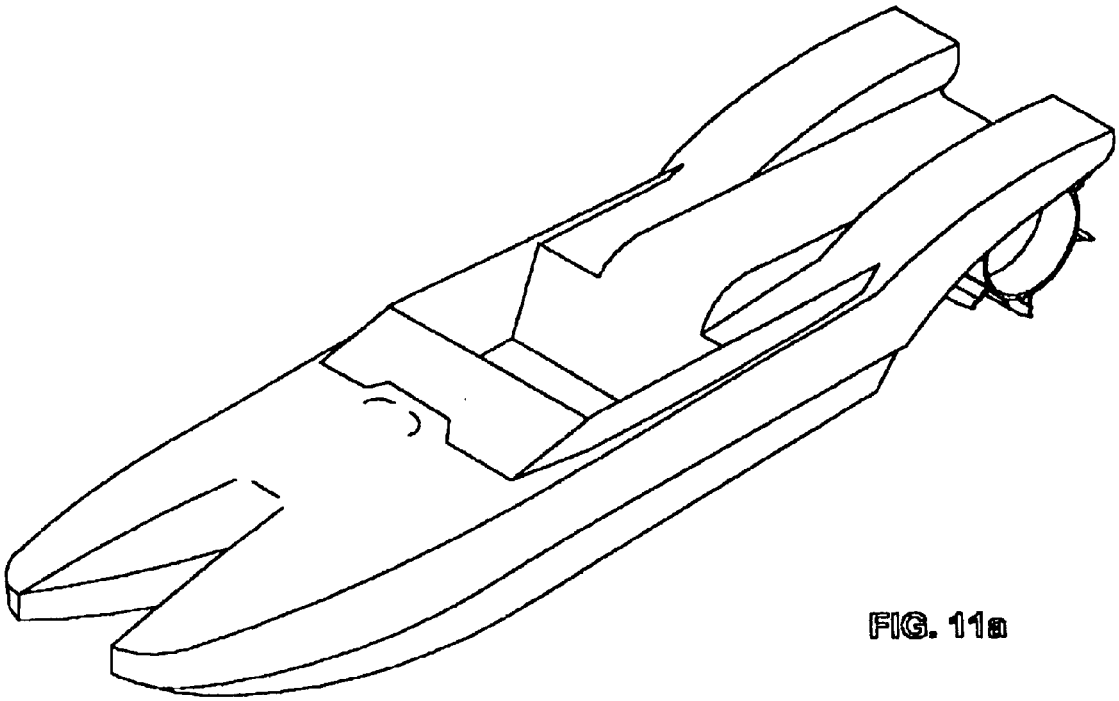
Figure 11B:
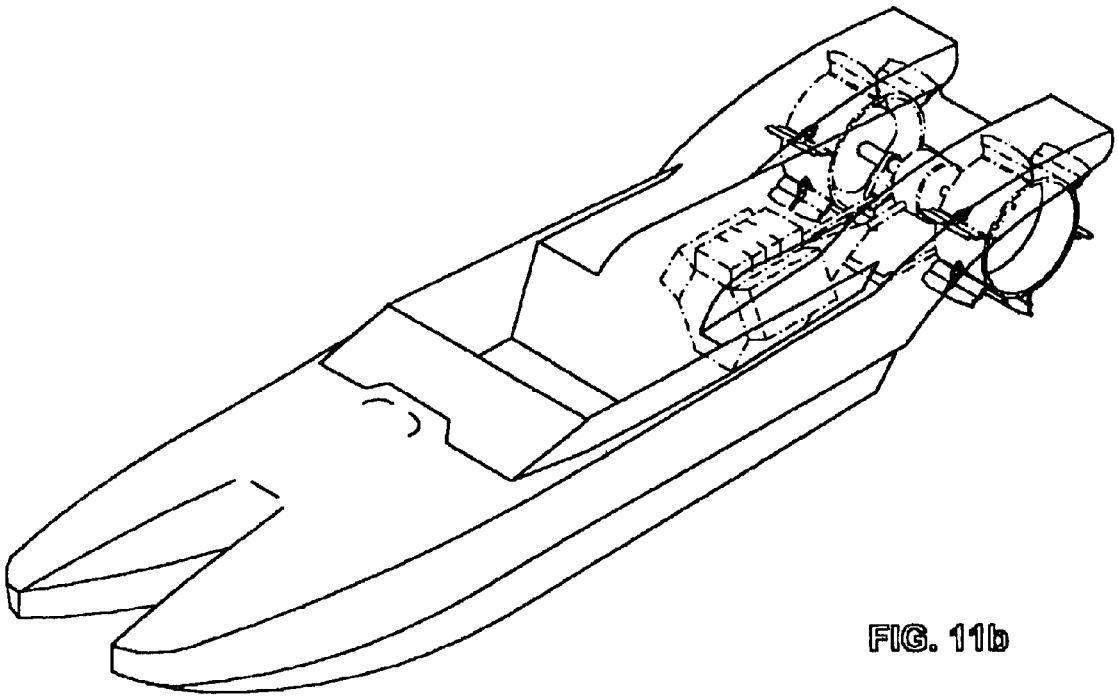

FIGS. 11*a* and 11*b* show isometric views of an alternate embodiment.

Figure 12A:
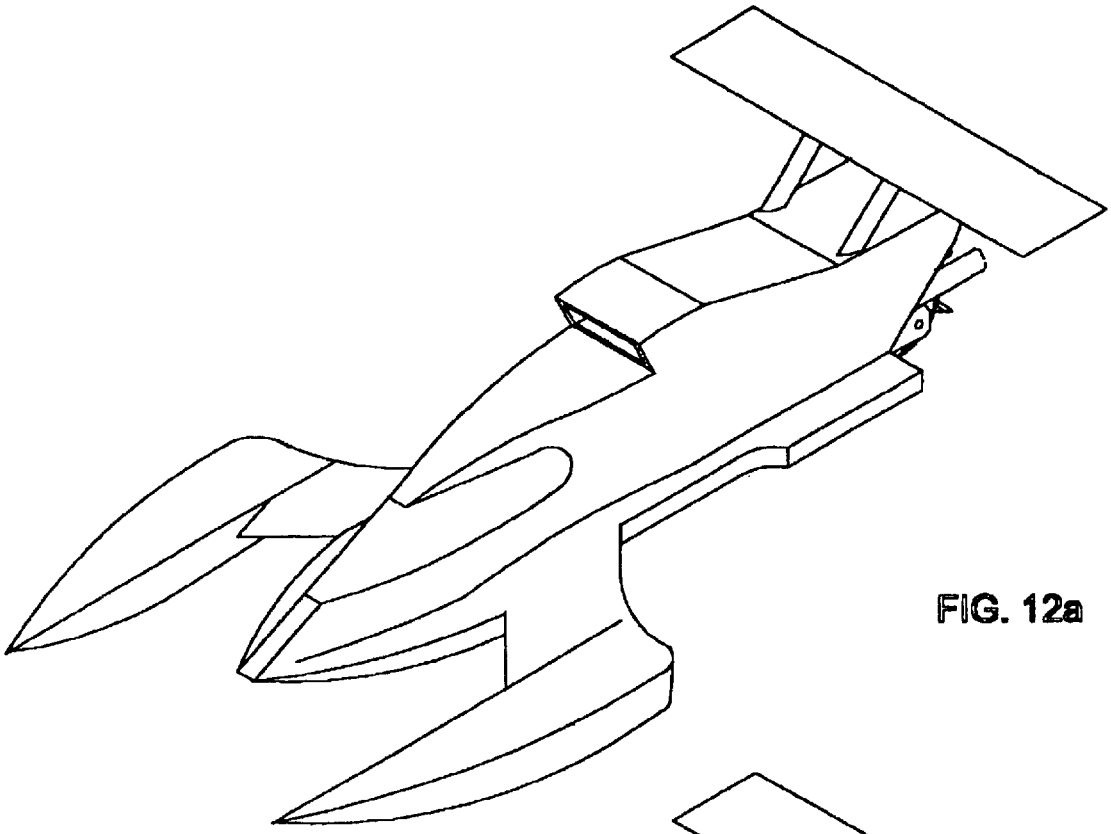
Figure 12B:
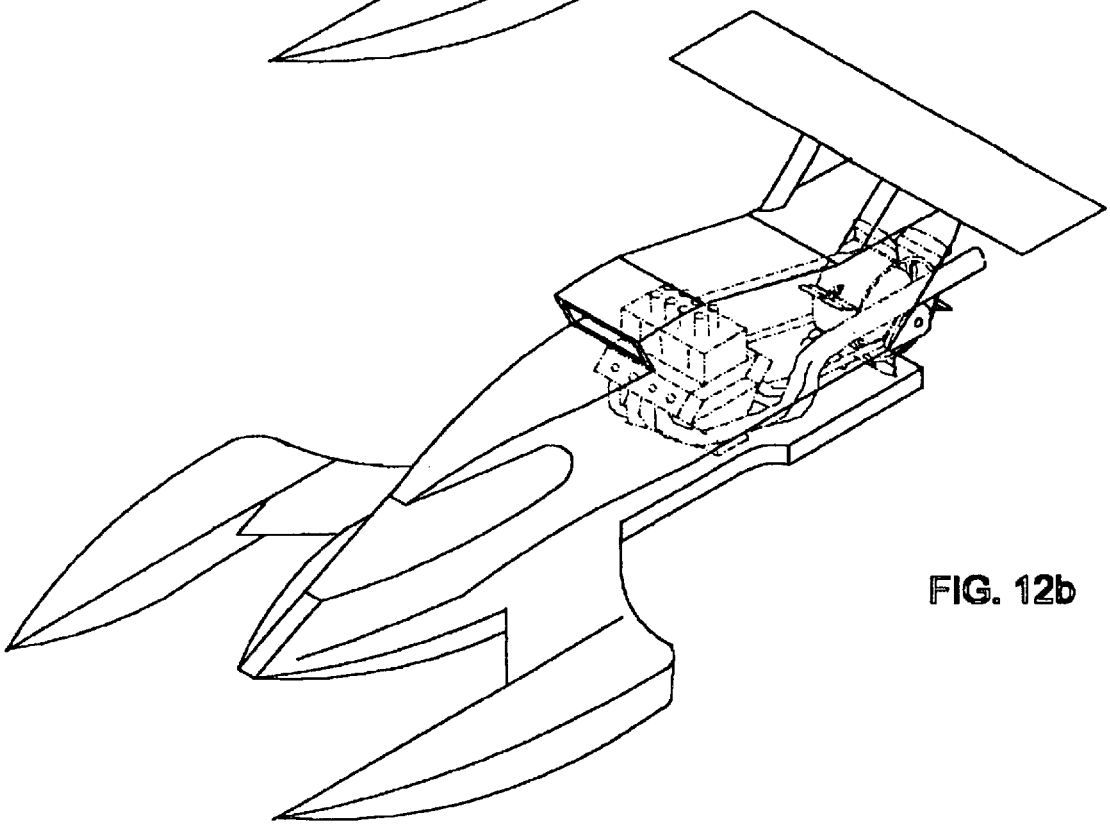

FIGS. 12*a* and 12*b* show isometric views of another alternate embodiment.

REFERENCE NUMERALS IN DRAWINGS

| | | | |
|---|---|---|---|
| 1 | blade support cylinder | 2 | blade |
| 3 | actuating lever assembly | 4 | load cam |
| 5 | axle | 6 | support member |
| 7 | bearing carrier | 8 | pulley |
| 9 | bearing | 10 | clip |
| 11 | hex nuts | 12 | washer & bolt |
| 13 | clip grooves | 14 | Radial Surface Drive |
| 15 | transmission | 16 | drive pulley |
| 17 | lower structural connection | 18 | upper structural connection |
| 19 | hydraulic ram - trim | 20 | drive belt |
| 21 | rudder assembly | 22 | hydraulic ram - load cam position |
| 23 | pin | 24 | hull outline |
| 25 | hydraulic ram - rudder position | 26 | bolts |
| 27 | drive shaft | 28 | shroud |
| 29 | hydraulic lines | 30 | engine |
| 201 | torsion spring | 202 | hinge pin |
| 203 | actuating lever | | |
| 300 | friction reducing element | 301 | pin |
| 302 | retainer | 303 | sealed bearings |
| 400 | steering wheel | 401 | N/A |
| 402 | trim and thrust control | 403 | N/A |
| 404 | control valve (steering) | 405 | control valve (trim) |

DETAILED DESCRIPTION

Figure 1:
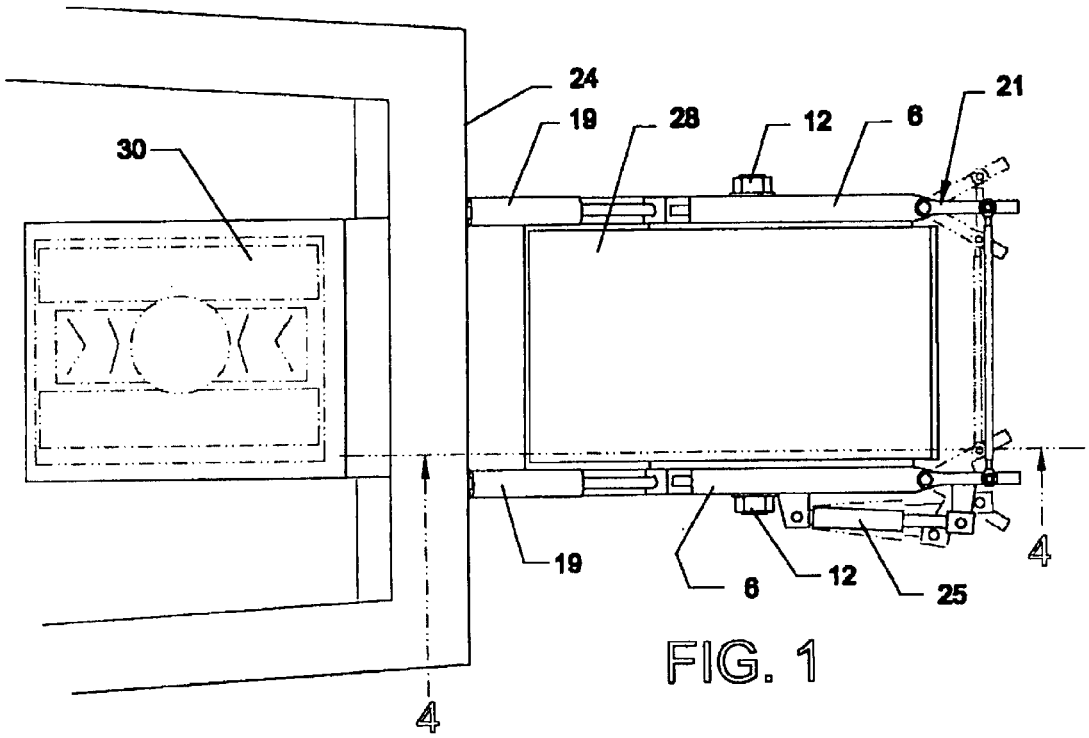
FIG. 1 shows a plan view of the preferred embodiment showing only the transom of a boat with an inboard engine with a reference to section drawing FIG. 4.
Figure 2:
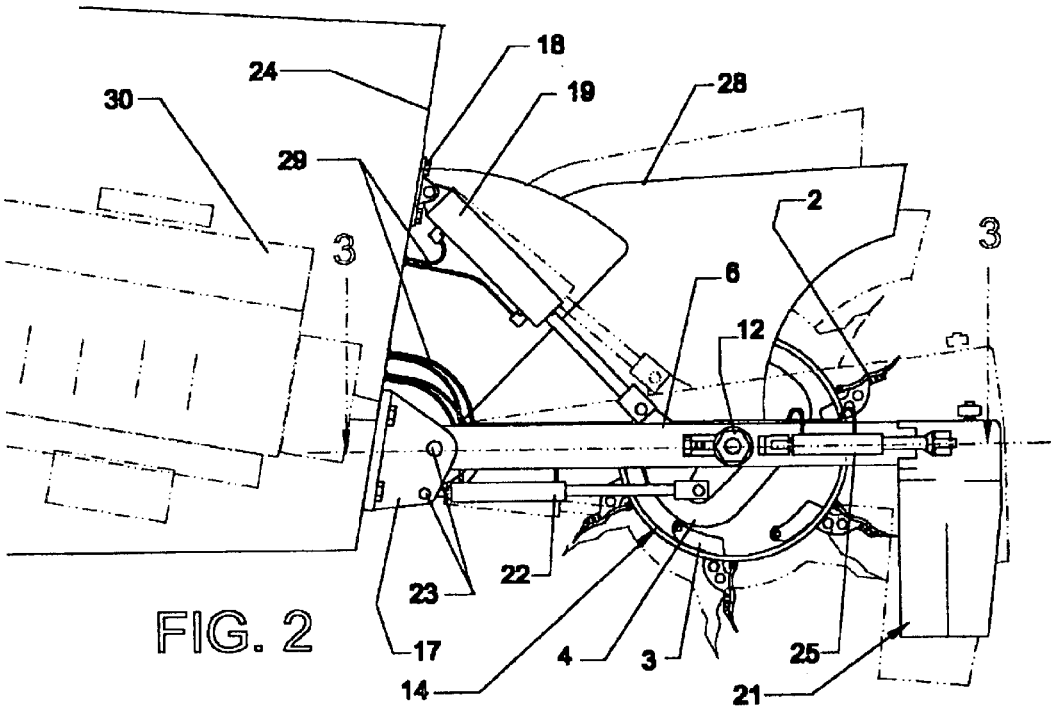
FIG. 2 shows the side elevation of the preferred embodiment with a reference to section drawing FIG. 3.

Description-FIGS. 1 through 2-Preferred Embodiment

A top and side view of the preferred embodiment of the present invention is illustrated in FIGS. 1 and 2 respectively. An adjustable member 6 supports a radial surface drive 14, and a rudder assembly 21. A pair of conventional hydraulic actuators 19 is operably connected between the support member 6 and a transom of a boat 24 and provides vertical support and trim control. Contracting or extending the actuators 19 in a conventional manner will alter the rearward elevation of the support member 6 as shown in FIG. 2. A single conventional hydraulic actuator 25 is operably connected to a rudder assembly 21 such that contracting or extending the actuator 25 in a conventional manner, will alter angle of the rudder assembly 21 as shown in FIG. 1. A conventional hydraulic actuator 22 is operably connected to a load cam 4 such that contracting or extending the actuator 22 in a conventional manner, will alter the position of the load cam 4 as shown in FIGS. 9*a*, 9*b*, 9*c* and 9*d*. Conventional hydraulic lines 29 provide a high pressure, flexible-connection between hydraulic actuators 19, 22, and 25, and a boat's conventional hydraulic control system as illustrated in FIG. 10. Structural connections 17 and 18 provide pivotable attachments for the support member 6 and actuators 19 respectively. These connections are formed of cast aluminum, however, any material with suitable strength and corrosion resistance can be used. Conventional stainless steel, press-fit pins 23 operably connect structural connections 18, to actuators 19. Said pins 23 operably connect actuators 19 to integrated tabs of support member 6.

Figure 3:
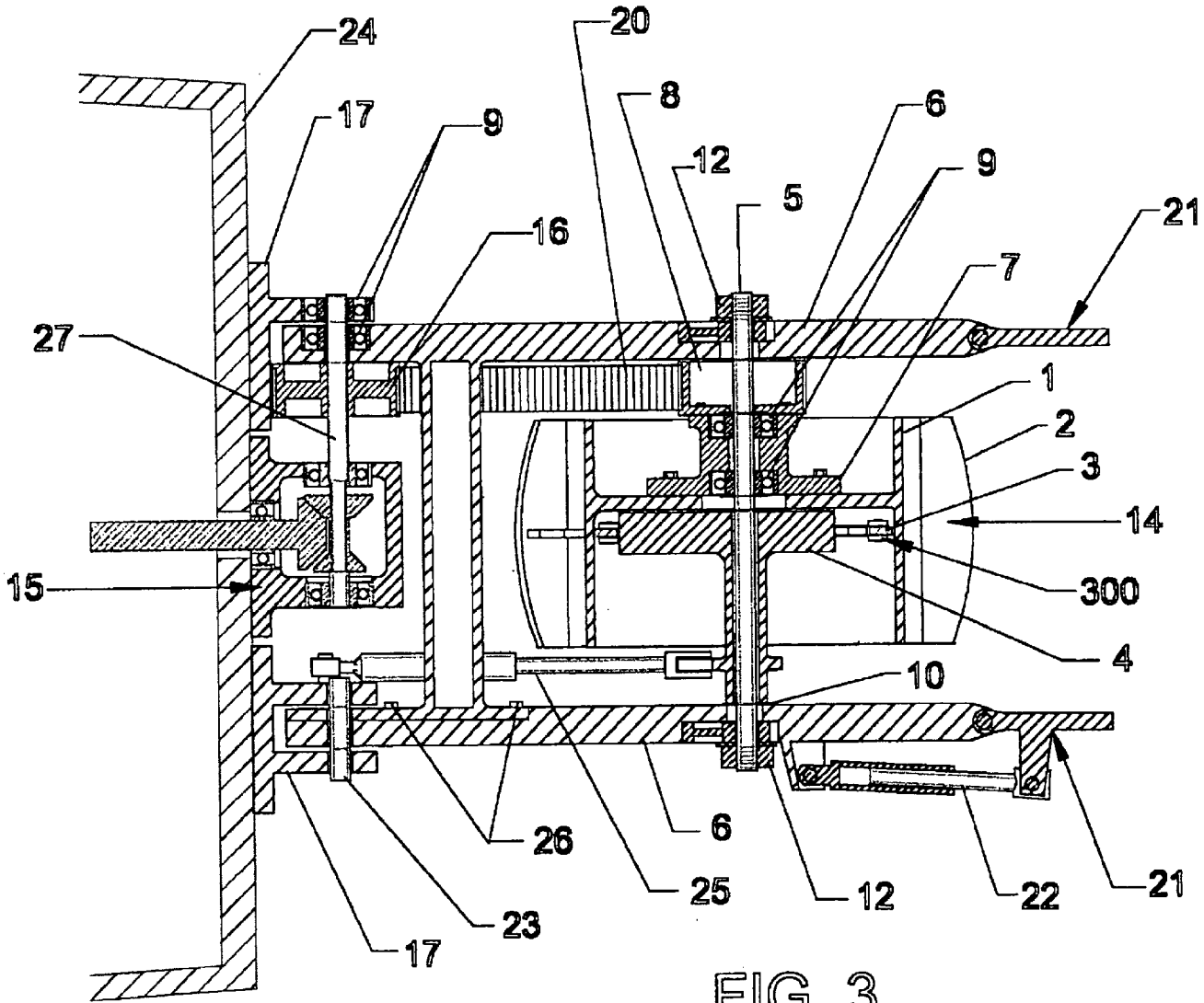
FIG. 3 shows the section referenced in FIG. 2.

FIG. 3-Preferred Embodiment

This section illustration is referenced in FIG. 2. It illustrates the placement of the load cam 4 within a blade support cylinder 1 and the arrangement of the load cam 4, a bearing carrier 7, a pair of conventional sealed, precision bearings 9, and conventional clips 10, along an axle 5. The axle 5 is fixed and does not rotate, however, minimal fore and aft movement is provided by adjustable journals to allow for tension adjustment of a conventional drive belt 20. Axle 5 is formed of stainless steel and has 5 grooves 13 at predetermined locations to receive conventional clips 10 and machine threads at each end to receive a bolt and washer 12. Clips 10 align the load cam 4, and bearings 9 of the bearing carrier 7, such that load cam 4 is centered within the cylinder 1. The bolt and washer 12 operably secure axle 5 to the support member 6. Load cam 4 is operably connected to hydraulic cylinder 22 and can pivot within a 150-degree range upon axle S. The load cam 4 is formed of forged aluminum with a brass insert bearing at the point of contact with axle 5 and a thin PTFE strip covering the load surface cam 4.

A conventional transmission assembly 15 is suitably mounted to the transom 24 and receives a rotational energy from an engine 30 (not shown). A drive shaft 27 exits the transmission 15 on axis of the support member 6 pivot point, and forms the attachment pin on the right side of the support member 6. Operably attached to the drive shaft 27 is a conventional drive pulley 16. A conventional pulley 8 and drive pulley 16 are matched in width and pitch with drive belt 20 and are suitable for the rotational energy applied. Pulley 8 and pulley 16 are operably connected by belt 20. Pulley 8 and 16 diameters can be changed to alter the final drive ratio. Pulley 8 and drive pulley 16 are formed of forged aluminum, however, any material with suitable strength and corrosion resistance can be used.

Bearings 9 support a pivot point within structural connection 17 on the right side of support member 6. The structural connection 17 located on the left side does not have a bearing and uses a conventional press-fit pin 23. The left pivot point of support member 6 has a brass insert bearing with a greasable fitting.

Figure 6:
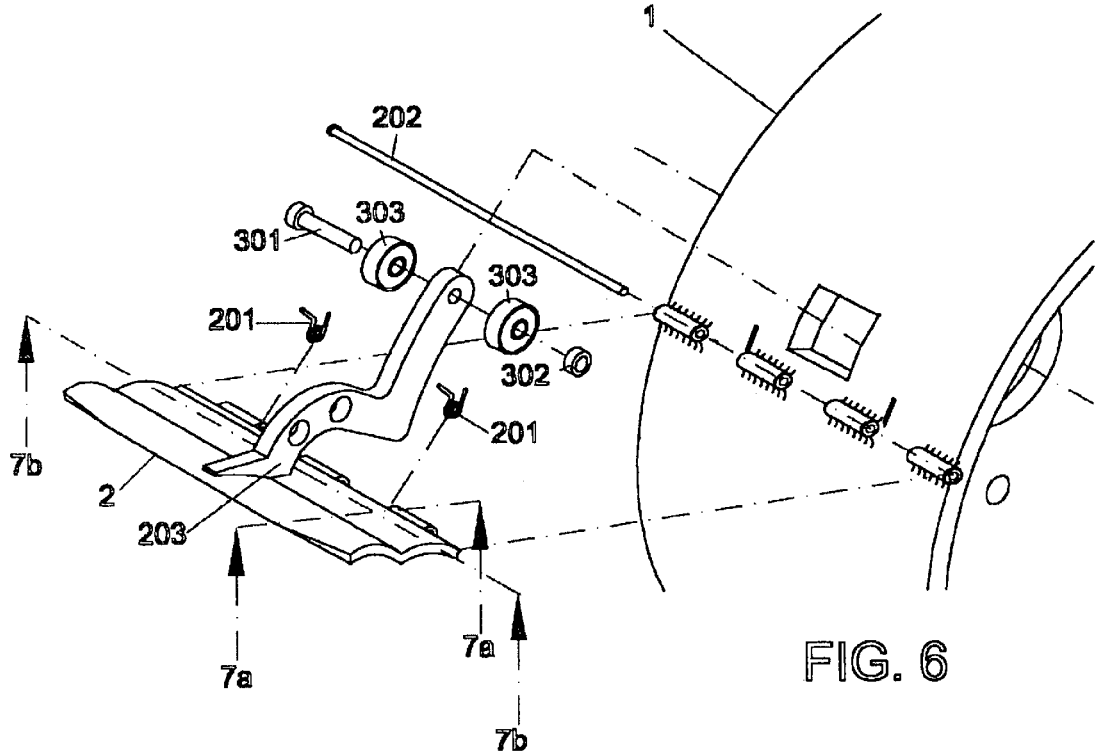
FIG. 6 shows an exploded detail of a blade and it's various parts with a reference to section drawings FIG. 7*a* and 7*b*.

Support cylinder 1 has an offset integral hub. Both the cylinder 1 and the hub are formed from aluminum, however, any material with suitable strength and corrosion resistance can be used. The diameter and width of cylinder 1 is sized according to boat size and available power. The outer surface of cylinder 1 is smooth and uniform and has provisions for six-identical, hinged blade configurations as illustrated in FIG. 6. Each hinge provision is equally spaced around the perimeter of the cylinder 1 as illustrated in FIG. 4, and is comprised of segmented aluminum tubing welded to the outer surface of the cylinder 1.

Figure 4:
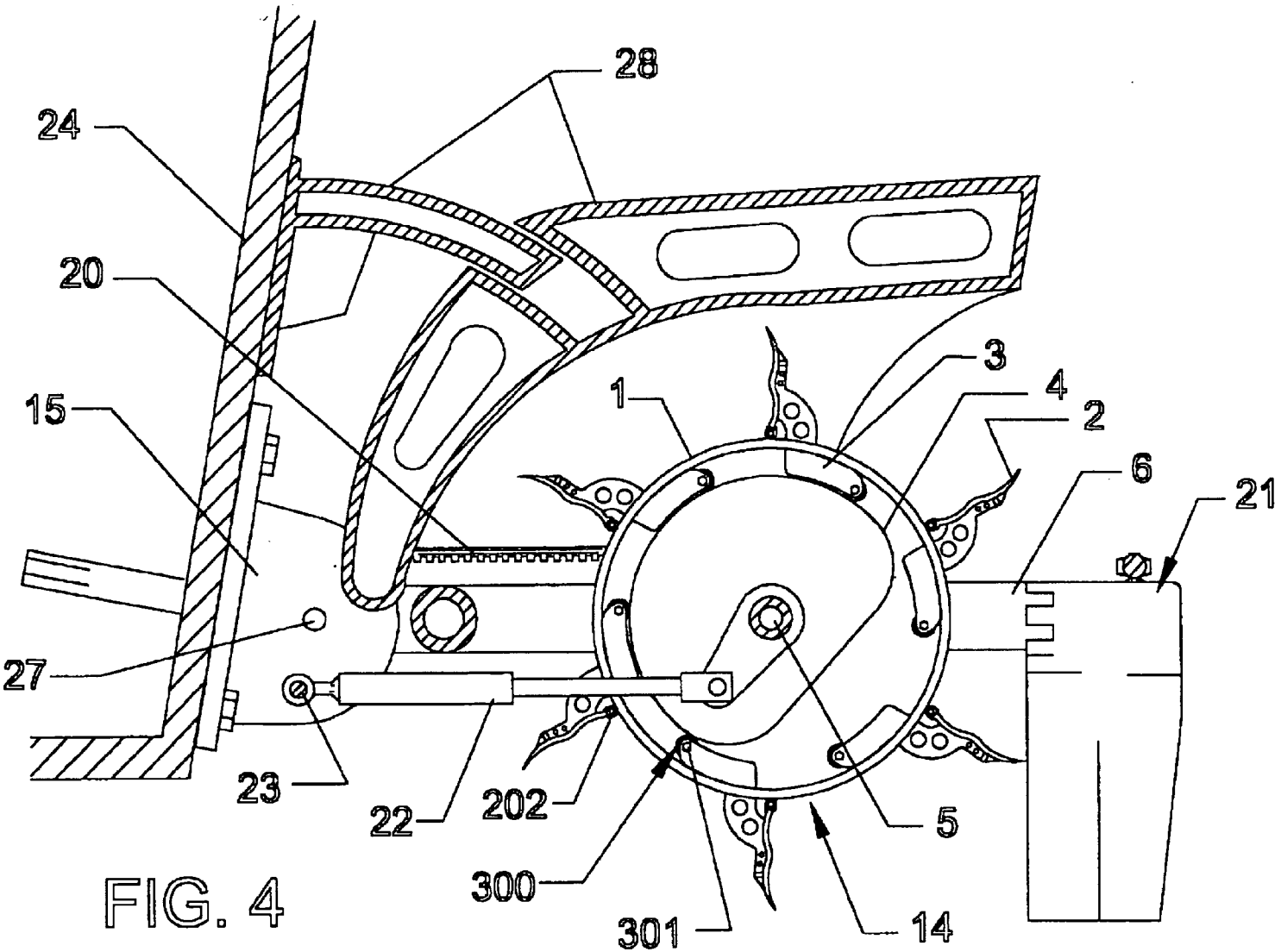
FIG. 4 shows the section referenced in FIG. 1.

FIG. 4-Preferred Embodiment

This section illustration is referenced in FIG. 1, and shows a side view of the placement of load cam 4 within the blade support cylinder 1. The radial surface drive of the present invention is presented with six blades 2, however, boat size and type will predetermine the number and size of the blades 2.

A shroud 28 encloses the radial surface drive of the present invention. As illustrated in FIG. 4, the shroud 28 is comprised of two components; a stationary component attached to transom 24 using a marine adhesive or other suitable means, and a larger interlocking component operably attached to support member 6 with conventional stainless steel fasteners. This view illustrates the interior of shroud 28, which is a shape similar to a parabola. This shape allows blades 2 to accelerate air within shroud 28 and aerate blades 2 as they enter the water, thus reducing problems associated with cavitation. As presented, the sections of shroud 28 is formed of a conventional composite material and can be shaped and colored in a manner consistent of the boat to which it is installed, however, the shroud can be formed of any material with suitable strength, corrosion resistance and operating characteristics.

Figure 5:
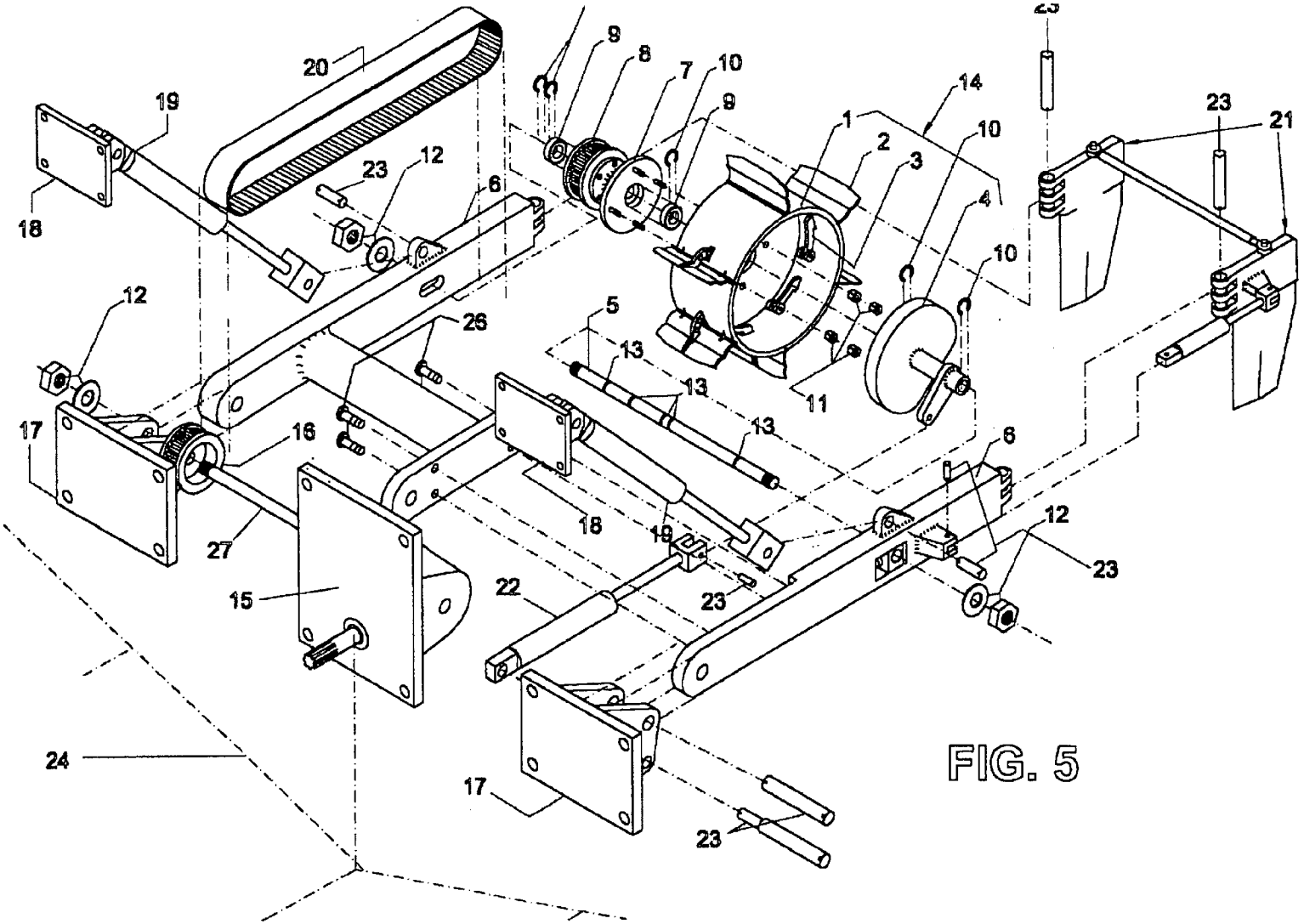
FIG. 5 shows an exploded view of the preferred embodiment.

FIG. 5-Preferred Embodiment

FIG. 5 shows an exploded, isometric view of the preferred embodiment. As presented, the support member 6 is comprised of two components connected with convention stainless steel bolts 26. Not shown in FIG. 5 is the shroud 28, hydraulic lines 29, and engine 30.

FIGS. 6, 7*a* and 7*b*-Preferred Embodiment

FIG. 6 shows an exploded, isometric connection detail for 1 of the 6, blades 2 of the preferred embodiment. Each blade 2 is configured to match the respective hinge provision of cylinder 1 and is pivotably coupled with a hinge pin 202. The blades 2, and the hinge pins 202 are formed of stainless steel, however, any material with suitable strength and corrosion resistance can be employed.

Said blades 2 have in common; an actuating lever 203, and a friction-reducing element 300. The levers 203 are attached to the back of each blade 2 by welding or other suitable means and have a mass and length that is specific to the boat application. Less mass and length on said lever 203 extends the responsiveness of cam 4 into higher rpm ranges. The lever 203 must operate through a respective opening provided in the cylinder 1. The friction-reduction element 300 of the preferred embodiment is comprised of a pair of conventional sealed precision bearings 303, a pin 301, and a retainer 302. The bearing pair 303, sandwich the end of the actuating lever 203. A space is provided within the hinge segments of each blade 2 to allow the placement of a pair of torsional springs 201 on pin 202.

Said blades 2 also have in common; a specific profile as illustrated in FIG. 7*a* and a cross-section as illustrated in FIG. 7*b*. Both features are concave with respect to the blade 2 fronts. The radius of each feature is specific to utility of the radial surface drive of the present invention. The radius of the concave features illustrated in FIG. 7*a* are 1.5 times the height of blade 2 and the radius of the concave feature illustrated in FIG. 7*b* substantially equals, 2.5 times the width of blade 2. These radiuses may be slightly different for different applications. In general terms, higher boat velocities, which require greater horsepower and associated drive rpm, requires less curve in the concave features of the blades.

FIGS. 8*a* and 8*b*-Preferred Embodiment

FIGS. 8*a* and 8*b* show isometric views of the assembled radial surface drive of the preferred embodiment looking through a transparent transom. FIG. 8*a* provides the configuration of the structural connections 17 and 18, and the relative placement of the transmission 15. This view also shows a conventional splined input shaft of the transmission 15. To simplify the drawing, the engine 30, a coupling to the transmission 15, and hydraulic lines 29 are not shown. In FIG. 8*b* a ghost view of the drive 14 is visible through various components.

FIGS. 9*a*, 9*b*, 9*c*, and 9*d*-Preferred Embodiment

These figures are operational in nature and will be discussed in the following "Operation" section.

FIG. 10-Preferred Embodiment

FIG. 10 shows a schematic illustration of the hydraulic control system. The hydraulic system includes a conventional power source 406 such as an electric motor suitably coupled to a conventional hydraulic pump 408. A conventional hydraulic fluid reservoir 407 and conventional 4-way and 2-way control valves 404 and 405 respectively, are suitably connected to pump 408. Trim actuators 19 and load cam actuator 22 is connected to control valve 404 by hydraulic lines 29. Rudder actuator 25 is suitably connected to control valve 405 by separate but similar hydraulic lines 29. Valve 405 is suitably connected to a conventional steering wheel 400 of the boat in a conventional manner while valve 404 is operably connected to a conventional, 4-way joystick type lever 402. Rotation of steering wheel 400 operates valve 405 thus controlling the flow of pressurized hydraulic fluid from pump 408, through lines 29, which will cause the extension or contraction of hydraulic actuator 25. In this manner rudder assembly 21 will pivot horizontally left or right as shown in FIG. 1. Movement up or down of lever 402 operates valve 404 thus controlling the flow of pressurized hydraulic fluid from pump 408, through separate lines 29, which will cause the. extension or contraction of hydraulic actuators 19. In this manner the support member 6 and all attached components will move up or down. Movement left or right of lever 402 operates valve 404 thus controlling the flow of pressurized hydraulic fluid from pump 408, through separate lines 29, which will cause the extension or contraction of hydraulic actuator 22. In this manner the load cam 4 will pivot upon the axle 5.

FIGS.-11*a* and 11*b*-Alternate Embodiments

FIGS. 11*a* and 11*b* illustrate a stylized application of the present invention. FIG. 11*a* illustrates a catamaran or "tunnel hull" style boat designed to optimize a pair of radial surface drives driven by a single engine. In this embodiment the power transfer is accomplished through the use of a conventional transmission and differential assembly. A single centered udder would be employed with separate trim and thrust controls for each drive. The shrouds are shown as integrated, stationary hull elements. In FIG. 11*b* a ghost view of the drives is visible through various hull components.

FIGS.-12*a* and 12*b*-Alternate Embodiments

FIGS. 12*a* and 12*b* illustrate another stylized application of the present invention. FIG. 12*a* illustrates a competition style boat designed to optimize a single radial surface drive driven by a single engine. In this embodiment the power transfer from engine to the drive is accomplished through the use of a conventional belt and pulley assembly. The transmission has been reduced to a simple a clutch allowing the operator to engage or disengage the engine from the belt assembly. The engine is installed transversely. The shroud as shown is an integrated, stationary hull element. In FIG. 12*b* a ghost view of the drive is visible through various hull components.

Advantages

From the description above, a number of advantages of my marine radial surface drive become evident:

(a) The radial surface drive will operate well rotating in a reverse direction. To this end I will offer that the quantified reduction of the drive's performance in the reverse direction should be minimal and irrelevant when compared to a boat's quantified reduction of performance moving in the reverse direction.

(b) The radial surface drive by design, has no associated lateral forces. This yields three advantages;

1) all available power produced by a boat's engine can be transferred to forward thrust, 2) the elimination of the skegs needed to overcome the lateral forces as seen in "surface piercing screw type propellers" of the prior art, results in less appendage drag, and 3) greater lateral stability a planing speeds, particularly in choppy conditions.

(c) The ability to alter the drive's elevation while underway allows the operator to control the ride angle (trim) of the boat. This allows the use of the radial surface drive on high speed planing hulls where trim angle is critical to overall performance. Paddlewheels of the prior art have not have been commercially used on high speed planing hulls.

(d) The load cam as described above is unique. In the finite terms of rotation, it allows each blade to release its load early as seen in FIG. 9*b*, or hold it longer as seen in FIG. 9*c*. When used in conjunction with the elevation adjustment, of the present invention, the amount of thrust released or held can be altered. This allows an engines most efficient RPM to used for almost any boat speed or laden weight. This is discussed in greater detail in the "Operation" section.

(e) The shroud allows the moving parts of the drive to be enclosed for purposes of safety without diminishing performance.

(f) The shroud improves performance by providing an enclosed space whereby the blades (accelerated by the load cam near the point of rotation where the blades enter the shroud), accelerate and pressurize air within the cavity behind each blade as it enters the water. During boat acceleration, this insures a volume of air behind each blade that is at a pressure equal to: or greater than: atmospheric, thus eliminating cavitation that could otherwise create vibrations that rob power and damage blades.

(g) Even with the inherent flexibility of the radial surface drive as described above, damage and wear will preserve the need to replace blades. An operator or owner can stand on a dock and with the drive raised, remove a pin and change the blade. The blades can be removed easily without removing the boat from the water.

Operation

The operation of the radial surface drive of the present invention can be simplified into four general modes of operation. These modes are;

(a) Idle-drive 14 is operating 0 to 200 rotations per minute (rpm)

(b) Cruising-drive 14 is operating within the 200 to 1800 rpm range (c) Maximum-drive 14 is operating with full power applied (d) Reverse-drive 14 is operating at idle in the reverse direction of rotation.

The rpm ranges as stated are for purposes of discussion and should be taken as such. Different boats of different applications will have distinctly different needs in terms of thrust, for example, a race or competition only vessel may never operate, of have capacity within its equipment to operate, in the reverse mode.

The idle mode, as shown in FIG. 9*a*, illustrates the relationship of the blades 2, support cylinder 1, load cam 4 and hydraulic actuator 22, as viewed from the left side with a dashed line representing the theoretical waterline. Other items have been omitted for purposes of simplifying the drawing.

An operator of a boat, floating on a body of water, having conventional controls. Further equipped with a conventional engine 30, transmission 15, and transom 24 and so equipped as to begin traveling in a forward direction, would place the engine's 30 controls at idle and transmission 15 in neutral and start engine 30 in a conventional manner. Activating power source 406 can now employ the boat's hydraulic system. The operator moves lever 402 up causing valve 404 to allow high-pressure fluid to flow from pump 408, through lines 29 into the ram side of cylinders 19. This causes cylinders 19 to contract, thus raising drive 14, rudder assembly 21 and attached components, above the surface of the water. The operator moves lever 402 left, causing a separate section of valve 404 to allow high-pressure fluid to flow from pump 408, through separate lines 29 into the ram side of cylinder 22. This causes cylinder 22 to contract, thus pivoting cam 4 clockwise (when viewed from the left). These movements place drive 14 at a maximum elevation above the surface of the water, and at a minimum thrust capability.

The operator now places transmission 15 in forward in a conventional manner, causing drive shaft 27 to turn pulley 16, associated drive belt 20 and pulley 8, thus rotating contiguous elements, bearing carrier 7, and drive 14 about axle 5. The operator moves lever 402 down causing valve 404 to allow high-pressure fluid to flow from pump 408, through lines 29 into the piston side of cylinders 19. This causes cylinders 19 to extend thus lowering drive 14, rudder assembly 21 and attached components, into the water. The boat begins slow forward movement. The distance drive 14 is lowered is a function of laden weight and desired rate of acceleration. The operator considers these variables when selecting the optimum drive elevation.

As illustrated in FIG. 9*a*, load cam 4 is in a full clockwise position. This cam position allows blades 2 to fold back under significant load at approximately the vertical centerline crossing at the bottom of the rotation. However, torsional springs 201, contiguous to each hinge, apply a counter force which is sufficient to transfer a small amount of rotational energy into forward thrust by maintaining blades 2 in a substantially extended position at low rpm.

At this point, if the operator increases the rpm of engine 30 thus increasing the rpm of drive 14 proportionally. The load at each blade 2 will exceed the counter force applied by springs 201 thus causing blades 2 to fold back when the force encountered when making contact with the water is applied. Therefore, the operator must move cam 4 into position prior to increasing engine 30 rpm.

The cruising mode begins when an increase of forward velocity is desired. FIG. 9*b* illustrates the left side view of the relationship of blades 2, support cylinder 1, load cam 4 and hydraulic actuator 22, for this mode, with a dashed line representing the theoretical waterline. The operator moves lever 402 right, causing valve 404 to allow high-pressure fluid to flow from pump 408, through lines 29 into the piston side of cylinder 22. This causes cylinder 22 to extend, thus pivoting cam 4 counter-clockwise. This places cam 4 at a position whereby contact between cam 4 and element 300 begins to occur at an early point of the sub-surface rotation of drive 14, whereby blades 2 do not fold back when said force is applied. The operator increases the rpm of engine 30 in a conventional manner, thus increasing the rpm of the drive 14 proportionally, thus increasing thrust produced by drive 14, thus increasing the forward velocity of the boat proportionally.

The operator may decide the bow of the boat is riding high for the given conditions and weight distribution within the boat. Moving lever 402 such that, cam 4 is rotated clockwise, or drive 14 is lowered slightly, or both can remedy this. In the cruising mode, both of these actions will have an effect on the relative elevation of the bow (trim).

The operator will monitor engine 30 rpm, forward speed, and trim of the boat. The operator will adjust the elevation of drive 14 and position of cam 4 such that the thrust delivered by drive 14 is suitable for optimum engine rpm and boat speed for the given conditions.

The maximum mode of operation begins anytime the operator of the boat desires maximum thrust or boat acceleration. This situation may be brought about through marine competition, adverse weather conditions, or other water sport activities. The steps are the same as discussed earlier, however, the emphasis is to transfer maximum power to the water rather than optimized cruising efficiency.

The maximum mode begins when the maximum forward velocity and rate of acceleration is desired. FIG. 9*c* illustrates the left side view of the relationship of blades 2, support cylinder 1, load cam 4 and hydraulic actuator 22, for this mode, with a dashed line representing the theoretical waterline. The operator moves lever 402 right, causing valve 404 to allow high-pressure fluid to flow from pump 408, through lines 29 into the piston side of cylinder 22. This causes cylinder 22 to extend, thus pivoting cam 4 fully counter-clockwise. This places cam 4 at a position whereby contact between the cam 4 and element 300 begins to occur at an early point of the sub-surface rotation of drive 14 and continues somewhat past the vertical center line. This maximizes the time blades 2 can produce usable thrust. The operator increases the rpm of engine 30 in a conventional manner, thus increasing the rpm of drive 14 proportionally, thus increasing thrust produced by drive 14, thus increasing the forward velocity of the boat proportionally. The rapid acceleration can elevate the bow slightly, as a result, the operator may decide to run drive 14 deeper than normal to compensate for this.

At very high rpm the mass and length of lever 203 contribute to performance. This occurs because the weight of lever 203 increases as a function of centrifugal velocity and begins to resist a portion of the load on the blade independently. This feature buffers the movements of blades 2 during the transition of load as the position of cam 4 is altered during high-speed operation and as blades 2 to move from air to water. This is a unique feature and key attribute of the radial surface drive's performance in high-speed applications.

The reverse mode of operation begins when the operator decides to reverse the direction of forward travel or to begin travel in the reverse direction. FIG. 9*d* illustrates the left side view of the relationship of blades 2, support cylinder 1, load cam 4 and hydraulic actuator 22, for this mode, with a dashed line representing the theoretical waterline.

The reverse mode can be employed at any submersed drive 14 elevation or cam 4 position. During counter rotation, force is applied to the back of blades 2, as a result, actuating lever 203 is applied against the inner surface of cylinder 1. This enables the blades 2 to remain fully extended under load and prevents conflict between element 300 and cam 4.

The operator of the boat, floating on water, so equipped as to begin traveling in a reverse direction, begins the reverse mode with engine 30 operating and its controls at idle, transmission 15 in neutral and drive 14 approximately 20% submerged. The operator places the transmission 15 reverse in a conventional manner. Thus causing drive shaft 27 to turn pulley 16, associated drive belt 20 and pulley 8, thus rotating contiguous elements, bearing carrier 7, and drive 14 about axle 5 in a clockwise direction when viewed from the left. The boat begins slow reverse movement. The distance drive 14 is lowered is a function of laden weight and desired rate of reverse velocity. The operator considers these variables when selecting the optimum drive elevation. At this point, the operator can increase the rpm of engine 30 thus increasing the rpm of drive 14 proportionally, as needed.

Conclusions, Ramifications, and Scope

Thus, the reader will see that the marine radial surface drive of the present invention provides a simple, efficient, and stable alternative to the "screw type propeller surface drives" and "paddlewheels" of prior art. The drive as presented, is versatile, and easily serviced and manufactured. Furthermore the radial surface drive has the additional advantages in that:

- it can to be raised or lower by the operator while underway to match the boat conditions and performance needs;
- the blades of the drive have a unique curve that provide efficient and stable thrust;
- the blades of the drive have a unique mass upon actuating lever that buffers blade movement thus reducing vibration at high rpm:
- the blades of the drive have a unique torsion spring on the hinge that buffers blade movement thus reducing vibration at low rpm:
- the angle of the blades can be altered while underway by the operator thus allowing the angle and magnitude of thrust delivered by the drive to be adjusted;
- the design of the drive provides good reverse characteristics;
- the shroud of the drive provides a safety cover as well as improving performance by reducing cavitation;
- the drive does not induce lateral force during operation and
- can be made from many different materials.

While my above description contains many specificities, these should not be construed as limitations on the scope of the invention, but rather as an exemplification of preferred embodiments thereof Many other variations are possible such as:

(a) A radial surface drive with suitably coupled outboard engine affixed to an articulated support suitably attached to the transom of a boat., whereby steering is brought about by the pivot of the engine and drive upon said transom support.

(b) A boat equipped with one or several radial surface drives and an electronic, programmable logic controller that is suitably connected to; load, tachometer, thermometer, position, pressure and velocity sensor input devices. In addition said controller suitably connected to output control elements specific to hydraulic actuators 19, 22, and 25, such that, the efficient operation of the boat is a matter of automated and preprogrammable input/output functions.

Accordingly, scope of the invention should be determined not by the embodiments illustrated, but by the appended claims and their legal equivalents.

What is claimed is:

1. A propulsion device for a boat on water having an engine and a transom comprising:

(a) a support member of predetermined length and width and extending rearwardly from the transom;

(b) means for attaching a rudder assembly to the rearward end of said member:

(c) means to connect said member to said transom whereby said member may pivot vertically at said connections within a controlled predetermined range;

(d) an axle which is positioned in a horizontal manner and parallel to the transom and suitably machined so as to receive and position components mentioned within these claims and having a predetermined diameter and length;

(e) means to journal said axle at a predetermined point within said member;

(f) a rotatable blade support cylinder and contiguous internal hub of predetermined size;

(g) a bearing carrier conventionally attached to said cylinder and having conventional bearings and journalled upon said axle;

(h) means to connect in a pivotable manner a plurity of blades to the outer surface of said cylinder substantially parallel to the center axis of said cylinder;

(i) a plurity of articulated blades of a predetermined width, height, shape and profile; each said blade having a front and a back relative to the direction of said cylinder rotation and a contiguous actuating levers of predetermined length and mass conventionally attached to said blades and extending inward through a respective openings within the wall of said cylinder a predetermined distance;

(j) a friction reducing element suitably attached to the end of said levers;

(k) a load control cam of predetermined shape and size located within said cylinder and pivotably journalled on said axle such that the ends of said actuating levers and contiguous friction reducing elements can make contact with said cam at any point about the rotation of said cylinder; whereby the extended blade angle with a load applied is substantially a function of cam shape, and relative position of said cam;

(l) means to pivot said cam upon said axle a predetermined range;

(m) means to secure said cam, and bearings and contiguous carrier, upon said axle at a predetermined position;

(n) a shroud conventionally secured to said member and of size and shape to substantially cover said drive with an internal surface and structure having the longitudinal section appearance of a parabolic curve and constructed to contain airborne water accelerated in upward and forward radial directions by said drive;

(o) means to receive rotational energy from said engine and transfer said energy to said cylinder;

Whereby said energy of said engine causes the rotation of said support hub and said cylinder about said axle causing said blades to contact said water producing a thrust proportional to said energy; whereby said elevations of said member and the positions and shape of said cam influence said thrust.

2. The marine radial surface drive of claim 1 wherein the means to attach a rudder assembly is:

(a) conventional hinge and pin assemblies suitably configured at the rearward ends of said member;

(b) a hydraulic ram pivotally attached between said member and said rudder assembly whereby extending or contracting said ram causes the rudder assembly to pivot left and right in a conventional manner.

3. The marine radial surface drive of claim 1 wherein the means to connect said support member to said transom is:

(a) a right and left structural connection of predetermined width suitably arranged to allow a pivotal point on said transom to which said member is conventionally connected and can pivot vertically and is stable laterally;

(b) a pair of conventional hydraulic cylinder rams of predetermined size and force with one end suitably attached to said transom at a predetermined point above said structural connections and the other end of said rams suitably attached at a predetermined point on said member such that contracting or extending said rams in a conventional manner will alter the relative elevation of the rearward end of said member.

4. The marine radial surface drive of claim 1 wherein the means to support said axle at a predetermined point of said member is: an adjustable journal suitably recessed within the right and left side of said member whereby the fore and aft position of said axle can be adjusted within the limited range of said journal.

5. The marine radial surface drive of claim 1 wherein the means to connect said blades to the outer surface of said cylinder is:

(a) a plurity of interlocking hinges of predetermined size; a portion of said hinges forming a contiguous part of said blades and a portion of said hinges forming a contiguous part of said cylinder;

(b) a hinge pin of length substantially equaling the width of said blade and formed of stainless steel;

(c) a torsional spring integral to said hinge whereby said blades are held in a full extended position relative to the axis of said cylinder by the torsional force applied by said springs when said blade support cylinder is not rotating.

6. The marine radial surface drive of claim 1 wherein the means to pivot said cam upon said axle a predetermined range is: a hydraulic ram suitably connected between said cam and the left structural connection such that extending or contracting said ram in a conventional manner will pivot said cam a predetermined range.

7. The marine radial surface drive of claim 1 wherein the means to secure said cam and said carrier upon said axle at a predetermined position are conventional grooves machined into said axle such that conventional clips will be suitably accepted into said grooves in a conventional manner.

8. The marine radial surface drive of claim 1 wherein the means to receive rotational energy from said engine and transfer said energy to said cylinder is:

(a) a conventional coupling between said engine and said transmission; said transmission is conventionally mounted on the exterior side of said transom and supports a conventional drive shaft journalled into the right side structural support;

(b) a toothed drive pulley suitably doweled upon said drive shaft;

(c) a toothed pulley of a configuration matching said drive pulley and conventionally attached to said bearing carrier;

(d) a drive belt of a configuration matching said pulleys and conventionally connecting said drive pulley to said pulley whereby said energy of said engine conveyed through said transmission will rotate said drive pulley thus causing said belt to rotate said pulley thus causing said bearing carrier and said cylinder to rotate.

9. The marine radial surface drive of claim 5 wherein said friction reducing element at the end of said actuating lever is a roller bearing assembly of predetermined size suitably attached to said lever.

10. The marine radial surface drive of claim 5, further including a blade design comprising;

(a) a side profile comprising two separate and discrete concave features with respect to the front of said blades each said feature having a radius equal to about 1.5 times the height of said blade and a subtended angle of about 150 degrees; said features extend the full width of said blades;

(b) a top profile comprising a concave feature with respect to the front of said blades said feature having a radius equal to about 2.5 times the width of said blade and a subtended angle of about 170 degrees;

(c) a leading edge or edge opposite the said hinge having a convex curve shape and said edge being beveled towards the back of said blades; said bevel finished at about a 45 degree angle.

11. The marine radial surface drive of claim 1 wherein said blades and contiguous actuating levers are formed of stainless steel.

12. The marine radial surface drive of claim 1 wherein said support member, said cylinder, said cylinder support hub and said load cam are formed of aluminum.

13. A propulsion drive for a boat having a conventional engine suitably coupled to a conventional transmission conventionally mounted to the exterior of a conventional transom and said drive comprising:

(a) a support member extending rearwardly, operably connected to said transom of said boat with means for causing said member to pivot vertically within a controlled predetermined range;

(b) adjustable journals at a predetermined point of each side of said member to support a horizontal axle perpendicular to said transom;

(c) an axle of predetermined diameter and length with conventional grooves machined into said axle such that conventional clips will be suitably accepted into said grooves in a conventional manner and machine threaded portions at each end to receive a bolt;

(d) a rotatable blade support cylinder and contiguous internal hub of predetermined size;

(e) a plurity of articulated blades operably connected to said support cylinder; said blades of predetermined width, height, shape and profile;

(f) a load control cam of predetermined shape and size located on said axle within said cylinder and journalled upon said axle and fixed into position with said clips and operably connected to said blades whereby the extended blade angle with a load applied is substantially a function of cam shape, and relative position of said cam (g) means to pivot said cam about said axle whereby the positions of said cam remains rigid during operation of said drive until intentionally adjusted;

(h) a bearing carrier with conventional bearings and conventionally attached to said cylinder and journalled upon said axle and fixed at a predetermined position upon said axle with said clips;

(i) a shroud conventionally secured to said member and of size and shape to substantially cover said drive with an internal surface and structure having the longitudinal section appearance of a parabolic curve and constructed to contain airborne water accelerated in upward and forward radial directions by said drive;

(j) a conventional rudder assembly pivotably attached on the rearward end of the support member with means to cause said assembly to pivot left and right a predetermined range;

(k) means to operably connect said drive to said transmission;

Whereby said energy of said engine causes the axial rotation of said bearing carrier and said cylinder about said axle causing said blades to contact said water producing a thrust proportional to said energy.

14. A marine radial surface drive of claim 13 further including said blades comprising:

(a) a front and a back relative to the direction of said cylinder rotation (b) an integral actuating lever of predetermined length and mass attached to the back of said blade and extending inward through an opening within said cylinder wall a predetermined distance substantially at a right angle relative said profile of said blade whereby said blade angle without load applied, is substantially a function of a centrifugal force applied to said mass of said lever; a friction reducing element to suitably attached to the end of said lever and positioned to make contact with said cam;

(c) a side profile comprising two separate and discrete concave features with respect to the front of said blades each said feature having a radius equal to about 1.5 times the height of said blade and a subtended angle of about 150 degrees; said features extend the fill width of said blades (d) a top profile comprising a concave feature with respect to the front of said blades; said feature having a radius equal to about 2.5 times the width of said blade and a subtended angle of about 170 degrees (e) an interlocking hinge of predetermined size; a portion of said hinge forming a contiguous part of said blade and a matching portion of said hinge forming a contiguous part of the said cylinder whereby interlocking portions of said hinge are pivotably joined with a pin having a length substantially equal to width of said blade whereby said pin may be repeatedly and easily removed to facilitate a replacement of said blade (f) a torsional spring integral to the hinge whereby said blade is held in a fully extended position relative to the axis of said cylinder by a torsional force applied by said spring when said drive is idle (g) a leading edge or edge opposite the said hinge of said blade having a convex curve shape; and said edge being beveled towards the back of said blade; said bevel finished at about a 45 degree angle.

15. The marine radial surface drive of claim 13 wherein the means to cause said member to pivot vertically within a controlled predetermined range is: a pair of conventional hydraulic cylinder rams of predetermined size and force with one end suitably attached to said transom at a predetermined point above said structural connections and the other end of said rams suitably attached at a predetermined point on said member whereby contracting or extending said rams in a conventional manner will cause the rearward end of said member to raise or lower.

16. The marine radial surface drive of claim 13 wherein the means to cause said rudder assembly to pivot left and right a predetermined range is: a hydraulic ram pivotally attached between said member and said assembly whereby extending or contracting said ram in a conventional manner causes the rudder assembly to pivot left and right in a conventional manner.

17. The marine radial surface drive of claim 13 wherein the means to receive rotational energy from said engine and transfer said energy to said cylinder is:

(a) a conventional coupling between said engine and said transmission; said transmission is conventionally mounted on the exterior side of said transom and supports a conventional drive shaft journalled into the right side structural support;

(b) a toothed drive pulley suitably doweled upon said drive shaft (c) a toothed pulley of a configuration matching said drive pulley and conventionally attached to said bearing carrier;

(d) a drive belt of a configuration matching said pulleys and conventionally connecting said drive pulley to said pulley whereby said energy of said engine conveyed through said transmission will rotate said drive pulley thus causing said belt to rotate said pulley thus causing said bearing carrier and said cylinder to rotate.

18. A marine radial surface drive of claim 13 wherein the means to pivot said cam about said axle is:

(a) a brass insert bearing within the load cam such that said cam material is not in contact with said axle but is in contact with brass bearing;

(b) a hydraulic ram suitably connected between said cam and the left structural connection such that extending or contracting said ram will pivot said cam a predetermined range.

19. The marine radial surface drive of claim 13 wherein said blade and contiguous actuating lever are formed of stainless steel.

20. The marine radial surface drive of claim 13 wherein the support member, the blade support cylinder, cylinder support hub and load cam are formed of aluminum.

* * * * *